US010731465B2

(12) United States Patent
Montgomery et al.

(10) Patent No.: US 10,731,465 B2
(45) Date of Patent: Aug. 4, 2020

(54) ROTOR AND VANE WITH INSERT

(71) Applicant: Torad Engineering LLC, Cumming, GA (US)

(72) Inventors: John Montgomery, Lilburn, GA (US); Gregory T. Kemp, Alpharetta, GA (US); Joseph Orosz, Woodstock, GA (US)

(73) Assignee: Torad Engineering LLC, Cumming, GA (US)

( * ) Notice: Subject to any disclaimer, the term of this patent is extended or adjusted under 35 U.S.C. 154(b) by 274 days.

(21) Appl. No.: 16/008,083

(22) Filed: Jun. 14, 2018

(65) Prior Publication Data

US 2018/0371913 A1 Dec. 27, 2018

Related U.S. Application Data

(60) Provisional application No. 62/525,254, filed on Jun. 27, 2017.

(51) Int. Cl.
*F01C 21/08* (2006.01)
*F04C 2/344* (2006.01)

(52) U.S. Cl.
CPC ..... *F01C 21/0809* (2013.01); *F01C 21/0881* (2013.01); *F04C 2/344* (2013.01); *F04C 2/3441* (2013.01)

(58) Field of Classification Search
CPC .. F01C 21/0809; F01C 21/0881; F04C 2/344; F04C 2/3441
See application file for complete search history.

(56) References Cited

U.S. PATENT DOCUMENTS

| | | | | |
|---|---|---|---|---|
| 3,158,103 | A | 11/1964 | Eickmann | |
| 3,398,884 | A * | 8/1968 | Kaatz | F01C 21/0809 418/152 |
| 2014/0112817 | A1* | 4/2014 | Osaki | F04C 18/344 418/266 |
| 2019/0017507 | A1* | 1/2019 | Heaps | F01C 21/0809 |

FOREIGN PATENT DOCUMENTS

| | | |
|---|---|---|
| FR | 533897 | 3/1922 |
| JP | 57059091 | 4/1982 |
| WO | 9904141 | 1/1999 |

* cited by examiner

*Primary Examiner* — Mary Davis
(74) *Attorney, Agent, or Firm* — Ballard Spahr LLP

(57) ABSTRACT

A rotor assembly has a vane which engages an eccentric cam block using an insert. The insert is removably attached to the vane. The vane is captured within a transverse slot in the rotor and executes reciprocal motion transversely to the axis of rotation of the rotor as the rotor rotates.

12 Claims, 3 Drawing Sheets

ROTOR AND VANE WITH INSERT

CROSS REFERENCE TO RELATED APPLICATIONS

This application is based upon and claims benefit of priority to U.S. Provisional Application No. 62/525,254, filed Jun. 27, 2017 and hereby incorporated by reference.

FIELD OF THE INVENTION

This invention concerns rotor assemblies for devices such as compressors, pumps and rotary engines.

BACKGROUND

Rotor and vane assemblies, wherein a vane reciprocates transversely to an axis of rotation of a rotor as the rotor turns, find extensive use in devices such as pumps, compressors and rotary engines. The rotor and vane assembly rotates within a housing and the vane engages a sidewall of the housing which is eccentric to the axis of rotation of the rotor. This eccentric configuration allows the rotor assembly to pump liquids, compress gases, or derive power from combustion of fuel though a thermodynamic cycle.

Advantages, such as lighter weight, lower pressure forces and reduced dead space remainder volume may be obtained by making the vanes as thin as possible. However, one of the design constraints which limits the thickness of a vane is the design of the engagement between the vane and the eccentric cam arrangement which enables the vane's reciprocal motion. There is clearly an opportunity to improve the operation of rotor assemblies by improving the engagement between the vane and cam in a rotor and vane assembly.

SUMMARY

The invention concerns a vane adapted for use with a rotor. In one example embodiment the vane comprises a plate. A slot extends transversely to one edge of the plate. The slot is defined by first and second oppositely disposed edges and a third edge oriented transversely to the first and second edges. An insert is removably mounted within the slot. By way of example the insert comprises a base engageable with the third edge of the slot. A first leg projects transversely to the base and is engageable with the first edge of the slot. A second leg projects transversely to the base and is engageable with the second edge of the slot.

In an example embodiment the vane may further comprise a fastener extending between the base and the third edge for removably securing the insert to the plate.

In another example embodiment the insert further comprises a first groove extending lengthwise along the first leg. The first groove is adapted to receive the first edge of the slot. By way of further example a second groove extends lengthwise along the second leg. The second groove is adapted to receive the second edge of the slot.

In an example embodiment the insert is "U" shaped. Further by way of example, a first support surface is positioned on the first leg. Also by way of example, a second support surface is positioned on the second leg. The first and second support surfaces are in facing relation with one another. In an example embodiment the first and second support surfaces have a width wider than a thickness of the plate.

The invention also encompasses a rotor and vane assembly engageable with an eccentric cam block. In an example embodiment, the rotor comprises a first hub. A second hub is coaxially aligned with the first hub. A vane housing is positioned between the first and second hubs. The vane housing comprises a cylindrical body having a longitudinal axis coaxially aligned with the first and second hubs. A slot extends through a diameter of the body and along the longitudinal axis. A shaft extends from the second hub and is coaxially aligned therewith. The vane is slidably positioned within the slot. IN an example embodiment the vane comprises a plate. A slot extends transversely to one edge of the plate. The slot is defined by first and second oppositely disposed edges and a third edge oriented transversely to the first and second edges. An insert is removably mounted within the slot. The insert is adapted to receive the eccentric cam block. In an example embodiment the insert comprises a base engageable with the third edge of the slot. A first leg projects transversely to the base and is engageable with the first edge of the slot. A second leg projects transversely to the base and is engageable with the second edge of the slot.

An example embodiment further comprises a fastener extending between the base and the third edge for removably securing the insert to the plate. In another example embodiment the insert comprises a first groove extending lengthwise along the first leg. The first groove is adapted to receive the first edge of the slot. By way of further example, a second groove extends lengthwise along the second leg. The second groove is adapted to receive the second edge of the slot.

In an example embodiment the insert is "U" shaped.

An example insert embodiment may further comprise a first support surface positioned on the first leg. A second support surface may also be positioned on the second leg. The first and second support surfaces are in facing relation with one another. In an example embodiment the first and second support surfaces have a thickness wider than a thickness of the plate.

DETAILED DESCRIPTION

Figure 1:
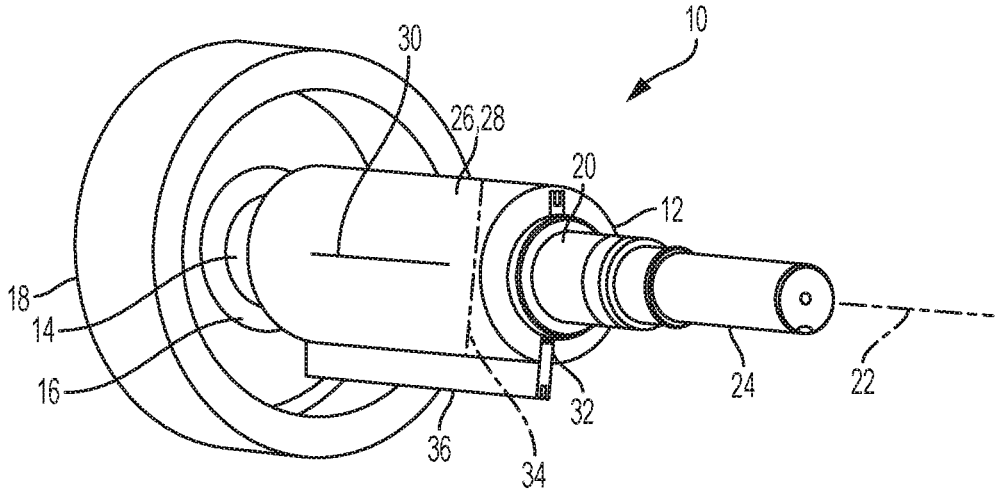
FIG. 1 is an isometric view of an example embodiment of a rotor and vane assembly according to the invention.

FIG. 1 shows an example embodiment of a rotor and vane assembly 10 according to the invention. Assembly 10 comprises a rotor 12. Rotor 12 comprises a first hub 14 which is received in a bearing 16 of a housing 18 of an apparatus, such as a compressor, pump or rotary engine in which the assembly 10 is used. A second hub 20 is coaxially aligned with the first hub 14, the second hub being received in another housing bearing (not shown). Hubs 14 and 20 cooperate with their respective bearings to support the assembly 10 for rotation about an axis of rotation 22 which is coaxially aligned with hubs 14 and 20. A shaft 24 extends from the second hub 20. Shaft 24 is coaxially aligned with hubs 14 and 20. When rotor assembly 10 is used in a compressor or pump, torque is applied to shaft 24 to turn the rotor and operate the apparatus. When rotor assembly 10 is used in a rotary engine shaft 24 is driven and provides torque to a transmission.

A vane housing 26 is positioned between the first and second hubs 14 and 20. Vane housing 26 comprises a cylindrical body 28 having a longitudinal axis 30 coaxially aligned with the first and second hubs 14 and 20 and the rotor axis of rotation 22. A slot 32 extends through a diameter 34 of the body 28. Slot 32 also extends lengthwise along the longitudinal axis 30 of the body 28. A vane 36 is slidably positioned within the slot 32.

Figure 2:
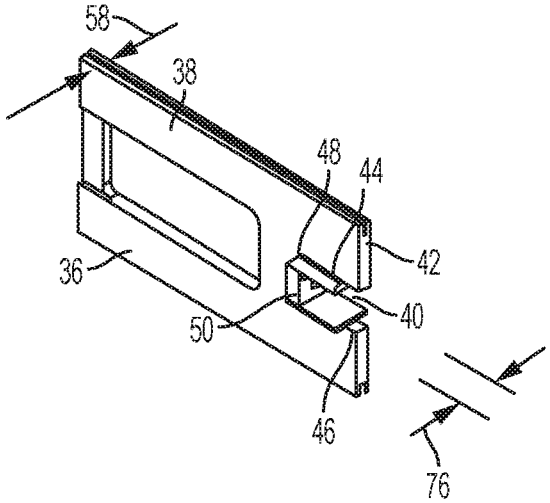
FIG. 2 is an isometric view of an example embodiment of a vane used in the rotor and vane assembly shown in FIG. 1.
Figure 3:
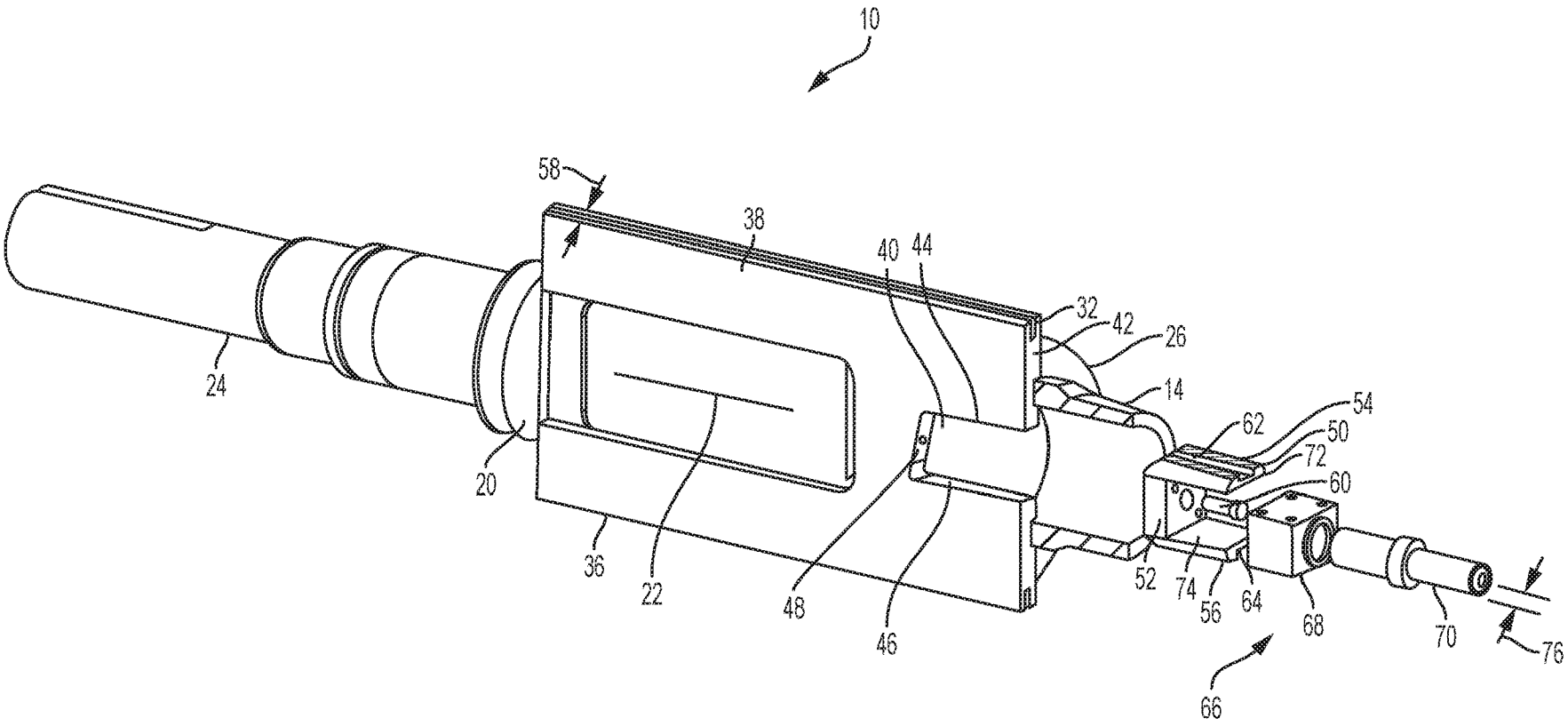
FIG. 3 is an exploded isometric view of the example rotor and vane assembly shown in FIG. 1.

FIG. 2 shows an example vane 36 in detail. Vane 36 comprises a plate 38 having a slot 40 extending transversely to one edge 42 of the plate. Slot 40 is defined by first and second oppositely disposed edges 44 and 46 and a third edge 48 oriented transversely to the first and second edges (see also FIG. 3). An insert 50 is removably mounted within the slot 40. As shown in FIG. 3, the insert 50 comprises a base 52 which is engageable with the third edge 48 of the slot 40. A first leg 54 projects transversely to the base 52 and engages the first edge 44 of the slot 40. A second leg 56 also projects transversely to the base 52 and engages the second edge 46 of the slot 40.

It is advantageous if insert 50 is removably mounted within the slot 40 on the plate 38 because it permits assembly of the rotor 12 and vane 36 when the rotor 12 is formed from a single billet or casting. As shown in FIG. 3, vane 36 may be inserted into the slot 32 of vane housing 26 and the insert 36 is then inserted through a hollow first hub 14 into engagement with the slot 40 in plate 38. As explained below, the insert 50 is wider than the slot 32 and the thickness 58 of plate 38, and thus the vane and insert cannot be inserted into the rotor through slot 32 as a sub-assembly.

In the example embodiment shown in FIGS. 2 and 3 the insert 50 has a "U" shape. Attachment of the insert 50 to the plate 38 is advantageously effected using a threaded fastener 60 extending between the insert's base 52 and the third edge 48 of the slot 40. Positive mechanical engagement between the legs 54 and 56 and the first and second edges 44 and 46 is augmented by positioning grooves in the legs. As shown in FIG. 3, the first leg 54 incorporates a first groove 62 extending lengthwise along the leg. Similarly, the second leg 56 incorporates a second groove 64 extending lengthwise along the leg. Grooves 62 and 64 are adapted to receive edges 44 and 46 of slot 40 and thus will have widths and depths appropriate to the design demands for the particular application in which the rotor and vane assembly 10 is used.

Figure 4:
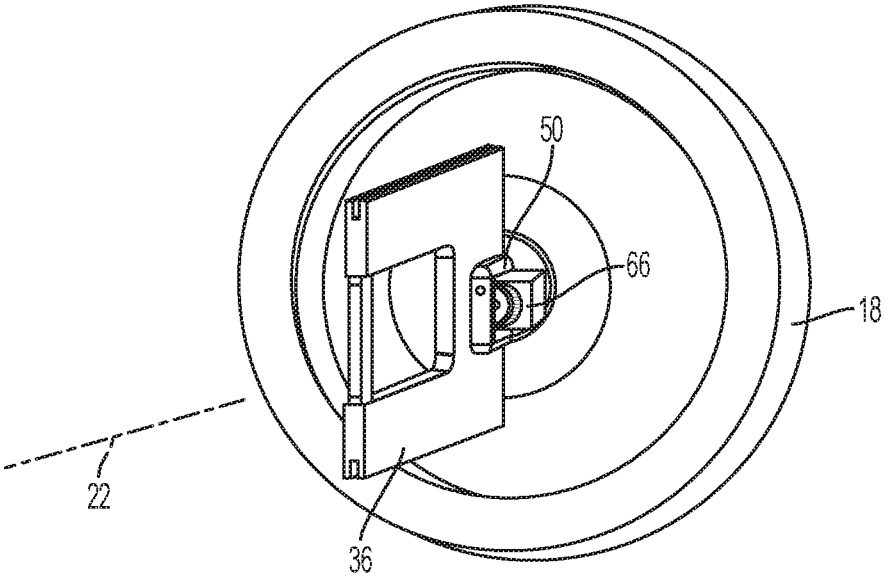
FIG. 4 is an isometric view of the vane shown in FIG. 2.

In operation, vane 36 reciprocates within the slot 32 of the vane housing 26 as the rotor 12 rotates about its axis 22. This reciprocal motion is effected by coupling the vane 36 to a cam block 66 (see FIGS. 3 and 4). Cam block 66 comprises a block 68 which is rotatably mounted on a shaft 70, the shaft being fixedly mounted relatively to the rotor 12 and eccentric to its axis of rotation 22. Design demands on the engagement between the vane 36 and the eccentric cam block 66 may require first and second support surfaces 72 and 74 respectively positioned on the first and second legs 54 and 56. The first and second support surfaces 72 and 74 are in facing relation with one another and slidingly engage the eccentric cam block 66 as the rotor 12 turns about its axis 22. To provide adequate engagement between the vane 36 and the eccentric cam block 66 the support surfaces 72 and 74 may have a width 76 wider than the thickness 58 of plate 38.

What is claimed is:

1. A vane adapted for use with a rotor, said vane comprising:

a plate;

a slot extending transversely to one edge of said plate, said slot being defined by first and second oppositely disposed edges and a third edge oriented transversely to said first and second edges;

an insert removably mounted within said slot, said insert comprising:

a base engageable with said third edge of said slot;

a first leg projecting transversely to said base and engageable with said first edge of said slot;

a second leg projecting transversely to said base and engageable with said second edge of said slot.

2. The vane according to claim 1, further comprising a fastener extending between said base and said third edge for removably securing said insert to said plate.

3. The vane according to claim 1, further comprising:

a first groove extending lengthwise along said first leg, said first groove adapted to receive said first edge of said slot;

a second groove extending lengthwise along said second leg, said second groove adapted to receive said second edge of said slot.

4. The vane according to claim 1, wherein said insert is "U" shaped.

5. The vane according to claim 1, further comprising:

a first support surface positioned on said first leg;

a second support surface positioned on said second leg, said first and second support surfaces being in facing relation with one another.

6. The vane according to claim 5, wherein said first and second support surfaces have a width wider than a thickness of said plate.

7. A rotor and vane assembly engageable with an eccentric cam block, wherein said rotor comprises:

a first hub;

a second hub coaxially aligned with said first hub;

a vane housing positioned between said first and second hubs, said vane housing comprising a cylindrical body having a longitudinal axis coaxially aligned with said first and second hubs, a rotor slot extending through a diameter of said cylindrical body and along said longitudinal axis;

a shaft extending from said second hub and coaxially aligned therewith;

said vane being slidably positioned within said rotor slot, said vane comprising:

a plate;

a vane slot extending transversely to one edge of said plate, said vane slot being defined by first and second oppositely disposed edges and a third edge oriented transversely to said first and second edges;

an insert removably mounted within said vane slot, said insert adapted to receive said eccentric cam block, said insert comprising:

a base engageable with said third edge of said vane slot;

a first leg projecting transversely to said base and engageable with said first edge of said vane slot;

a second leg projecting transversely to said base and engageable with said second edge of said vane slot.

8. The rotor and vane assembly according to claim 7, further comprising a fastener extending between said base and said third edge for removably securing said insert to said plate.

9. The rotor and vane assembly according to claim 7, further comprising:

a first groove extending lengthwise along said first leg, said first groove adapted to receive said first edge of said vane slot;

a second groove extending lengthwise along said second leg, said second groove adapted to receive said second edge of said vane slot.

10. The rotor and vane assembly according to claim 7, wherein said insert is "U" shaped.

11. The rotor and vane assembly according to claim 7, further comprising:

a first support surface positioned on said first leg;

a second support surface positioned on said second leg, said first and second support surfaces being in facing relation with one another.

12. The rotor and vane assembly according to claim 11, wherein said first and second support surfaces have a thickness wider than a thickness of said plate.

* * * * *